US007227343B2

(12) United States Patent
Jiang et al.

(10) Patent No.: US 7,227,343 B2
(45) Date of Patent: Jun. 5, 2007

(54) LINEAR VOLTAGE REGULATOR WITH SELECTABLE OUTPUT VOLTAGE

(75) Inventors: Wu Jiang, Shenzhen (CN); Yong-Zhao Huang, Shenzhen (CN); Yong-Xing You, Shenzhen (CN)

(73) Assignees: Hong Fu Jin Precision Industry (Shenzhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/308,692

(22) Filed: Apr. 22, 2006

(65) Prior Publication Data

US 2007/0029983 A1 Feb. 8, 2007

(30) Foreign Application Priority Data

Aug. 5, 2005 (CN) ..... 2005 1 0036443

(51) Int. Cl.
*G05F 1/00* (2006.01)
*G05F 1/565* (2006.01)

(52) U.S. Cl. ..... 323/274; 323/273; 323/275

(58) Field of Classification Search ..... 323/274, 323/273

See application file for complete search history.

(56) References Cited

U.S. PATENT DOCUMENTS

| | | | | |
|---|---|---|---|---|
| 5,231,316 | A * | 7/1993 | Thelen, Jr. | 327/103 |
| 5,467,009 | A * | 11/1995 | McGlinchey | 323/269 |
| 5,963,439 | A * | 10/1999 | Wuidart et al. | 363/46 |
| 6,020,727 | A * | 2/2000 | Bernard et al. | 323/269 |
| 6,583,607 | B1 * | 6/2003 | Marty et al. | 323/273 |
| 6,861,901 | B2 | 3/2005 | Prexl et al. | |
| 7,068,019 | B1 * | 6/2006 | Chiu | 323/281 |

* cited by examiner

*Primary Examiner*—Bao Q. Vu
(74) *Attorney, Agent, or Firm*—Wei-Te Chung

(57) ABSTRACT

A linear voltage regulator provides a selectable output voltage to a load. The linear voltage regulator includes: a regulating circuit including an input terminal for receiving an input voltage, an output terminal for providing an output voltage to a load, and an adjusting terminal; a first resistor and a second resistor connected between the output terminal and ground for receiving the output voltage; and a voltage sampling control circuit electrically connected to a node between the first resistor and the second resistor for receiving logic signals from a controlling chip, and generating a reference current to the adjusting terminal of the regulating circuit to provide the selectable output voltage.

14 Claims, 3 Drawing Sheets

LINEAR VOLTAGE REGULATOR WITH SELECTABLE OUTPUT VOLTAGE

CROSS-REFERENCES TO RELATED APPLICATION

Relevant subject matter is disclosed in the copending U.S. patent application entitled "linear voltage regulator" with application Ser. No. 11/283,287, which is filed on Nov. 17, 2005 and assigned to the same assignee with this patent application.

FIELD OF THE INVENTION

The present invention relates to voltage regulators, and particularly to a linear voltage regulator for providing a selectable output voltage to a load mounted on a motherboard.

DESCRIPTION OF RELATED ART

Linear voltage regulators are widely used to supply power to electronic devices, such as to a load on a motherboard of a computer. Such linear voltage regulators are available in a wide variety of configurations for many different applications.

Referring to FIG. 3, a typical linear voltage regulator 1 includes a voltage regulator IC (Integrated Circuit) 10. The voltage regulator IC 10 includes an adjusting terminal 11, an input terminal 12, and an output terminal 13. The adjusting terminal 11 receives a reference voltage V1. The input terminal 12 receives an input voltage Vin, and is grounded via a first filter capacitor C1. The output terminal 13 provides an output voltage Vout to a load RL, and is grounded via a second filter capacitor C2. Two resistors R1 and R2 are connected in series, between the output terminal 13 and ground. A node N between the resistors R1 and R2 provides the reference voltage V1 to the adjusting terminal 11.

When the resistor R1 or the resistor R2 has an appropriate impedance, the output voltage Vout can be regulated at a required level.

However, in the voltage regulator IC 10, the output voltage Vout is not adjustable with a change in input voltage Vin, such as when the input voltage Vin is 3.3V, the output voltage Vout is 2.5V, and when the input voltage Vin is 3.5 for example, the output voltage Vout is still 2.5V. Furthermore, when a selectable output voltage Vout is required between 2.5V and 2.8V, the linear voltage regulator 1 cannot provide an adjustable output voltage Vout to the load RL.

What is needed is a linear voltage regulator which is able to provide a selectable output voltages to a load.

SUMMARY OF THE INVENTION

An exemplary linear voltage regulator which provides a selectable output voltage to a load in accordance with a preferred embodiment includes: a regulating circuit including an input terminal for receiving an input voltage, an output terminal for providing an output voltage to a load, and an adjusting terminal; a first resistor and a second resistor connected between the output terminal and ground for receiving the output voltage; and a voltage sampling control circuit electrically connected to a node between the first resistor and the second resistor including a third resistor and a fourth resistor, a common terminal of the third resistor and the fourth resistor is connected to the node between the first resistor and the second resistor; the other terminals of the third resistor and the fourth resistor act as controlling signal input ends for receiving logic signals from a controlling chip, the voltage sampling control circuit generates a reference current to the adjusting terminal of the regulating circuit to provide a selectable output voltage.

Other advantages and novel features will become more apparent from the following detailed description, in which:

DETAILED DESCRIPTION OF THE INVENTION

Figure 1:
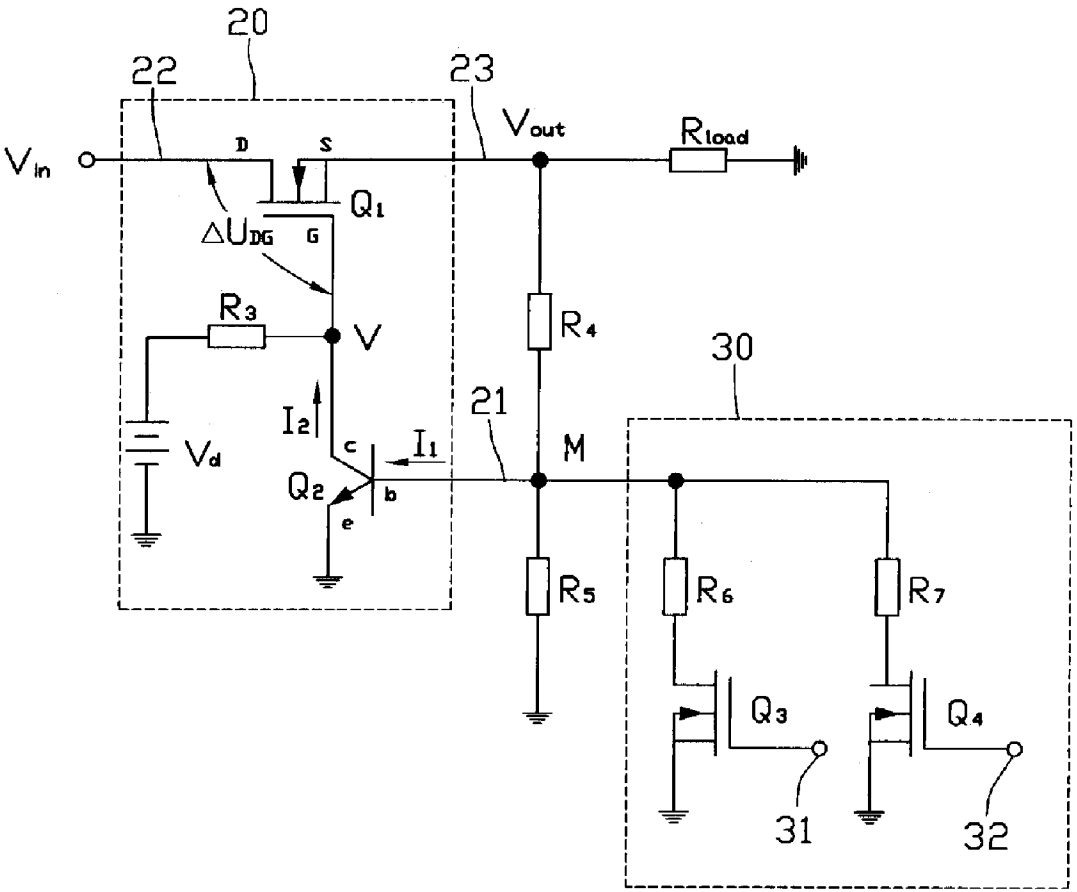
FIG. 1 is a circuit diagram of a linear voltage regulator which provides a selectable output voltage in accordance with a first embodiment of the present invention.

As shown in FIG. 1, in a first embodiment of the present invention, a linear voltage regulator includes a regulating circuit 20, a voltage divider (not labeled), and a voltage sampling control circuit 30. The regulating circuit 20 includes an adjusting terminal 21, an input terminal 22, and an output terminal 23. The adjusting terminal 21 receives a reference current I1. The input terminal 22 receives an input voltage Vin. The output terminal 23 provides an output voltage Vout to a load Rload. The voltage divider includes a first resistor R4 and a second resistor R5. The first resistor R4 and the second R5 are connected in series between the output terminal 23 and ground. A node M between the first resistor R4 and the second resistor R5 provides the reference current I1.

The regulating circuit 20 includes a regulating means Q1, a transistor Q2, and a current-limiting resistor R3. The regulating means Q1 is a N-channel metal-oxide-semiconductor field-effect transistor (MOSFET). The transistor Q2 is a bipolar transistor.

A base of the transistor Q2 receives the reference current I1. An emitter of the transistor Q2 is grounded. A collector of the transistor Q2 is connected to a gate of the regulating means Q1. The gate of the regulating means Q1 is coupled to a driving voltage Vd via the current-limiting resistor R3 as a controlling pole. A drain of the regulating means Q1 is connected to the input terminal 22 as the input pole, for receiving the input voltage Vin. A source of the regulating means Q1 is connected to the output terminal 23 as the output pole, for providing the output voltage Vout.

The voltage sampling control circuit 30 includes a third resistor R6, a fourth resistor R7, a first switch Q3, and a second switch Q4. The first switch Q3 and the second switch Q4 are respectively P-channel MOSFETs. A common terminal of the third resistor R6 and the fourth resistor R7 is connected to the node M between the first resistor R4 and the second resistor R5, and the other terminals of the third resistor R6 and the fourth resistor R7 are respectively connected to first terminals of the first switch Q3 and the second switch Q4. Second terminals of the first switch Q3 and the second switch Q4 are respectively connected to ground. Third terminals of the first switch Q3 and the second switch Q4 act as a pair of controlling signal input ends 31 and 32 to selectively control the third resistor R6 and the fourth resistor R7 connected to ground for participating in output voltage Vout sampling.

The controlling signal input ends 31 and 32 are used for receiving logic signals from a controlling chip (Model IP8203R, for example) mounted to a motherboard, for generating an orderly range of output voltages. In this embodiment, there are four different output voltages, a value of a difference between each output voltage being same. For example, there are four output voltages a, b, c, and d. The output voltage a is largest and the output voltage d is smallest, then their relationship to each other can be expressed as a−b is equal to b−c, and b−c is equal to c−d. The logic signals are respectively "11", "10", "01", and "00", wherein "1" represents logic high value, and "0" represents logic low value. When controlling signal input ends 31 and 32 receive the logic signals, the output voltage will be as follows.

When receiving the logic signal "11", the first switch Q3 and the second switch Q4 are turned on, therefore the third resistor R6 and the fourth resistor R7 are grounded. When grounded, the third resistor R6 and the fourth resistor R7 cooperate with the first resistor R4 and the second resistor R5 to form a voltage divider. The second resistor R5, the third resistor R6, and the fourth resistor R7 are connected in parallel, and together connected in series with the first resistor R4. The output voltage Vout can be expressed as:

$$Vout = Vref * \left(1 + \frac{R4}{\frac{\frac{R5 * R6}{R5 + R6} * R7}{\frac{R5 * R6}{R5 + R6} + R7}}\right)$$

When receiving the logic signals "10", the first switch Q3 is turned on, the second switch Q4 is turned off, therefore the third resistor R6 is grounded, and the second switch Q4 is in an open state. When grounded, the third resistor R6 cooperates with the first resistor R4 and the second resistor R5 to form a voltage divider. The second resistor R5 and the third resistor R6 are connected in parallel, and together connected in series with the first resistor R4. The output voltage Vout can be expressed as:

$$Vout = Vref * \left(1 + \frac{R4}{\frac{R5 * R6}{R5 + R6}}\right)$$

When receiving the logic signals "01" in the same way, the first switch Q3 is turned off, and the third resistor R6 is an open state. The second switch Q4 is turned on, therefore the fourth resistor R7 is grounded. When grounded, the fourth resistor R7 cooperates with the first resistor R4 and the second resistor R5 to form a voltage divider. The second resistor R5 and the fourth resistor R7 are connected in parallel, and together connected in series with the first resistor R4. The output voltage Vout can be expressed as:

$$Vout = Vref * \left(1 + \frac{R4}{\frac{R5 * R7}{R5 + R7}}\right)$$

When receiving the logic signals "00" in the same way, the first switch Q3 and the second switch Q4 are turned off, therefore the third resistor R6 and the fourth resistor R7 are in open states. The first resistor R4 cooperates with the second resistor R5 to form the voltage divider. The output voltage Vout can be expressed as:

$$Vout = Vref * \left(1 + \frac{R4}{R5}\right)$$

When an output voltage Vout suddenly becomes larger, the Vref becomes larger as well, therefore the adjusting current I1 becomes correspondingly larger. A collector current I2 becomes correspondingly larger. Then a voltage ΔUDG between the drain and the gate of the regulating means Q1 becomes higher. The increase of the voltage ΔUDG induces a decrease of the output voltage Vout. Therefore the load Rload voltage drops to a same level as before the sudden increase thereof.

Contrarily, when the output voltage Vout suddenly becomes lower, the Vref becomes lower, the adjusting current I1 becomes correspondingly smaller, and the collector current I2 becomes smaller correspondingly. Then the voltage UDG between the drain and the gate of the regulating means Q1 becomes lower. The decrease of the voltage ΔUDG induces an increase of the output voltage Vout. Therefore the load Rload voltage climbs to a same level as before the sudden decrease thereof.

In the first embodiment, the input voltage Vin is 3.3V, and the driving voltage Vd is 12V. In such case, a relationship of the controlling signal input ends 31 and 32 receiving the logic signals and the output voltage Vout is shown as follows:

TABLE 1

Relationship Between Logic Signals and Output Voltage

| Controlling Signal Input End 31 | Controlling Signal Input End 32 | Output voltage Vout(V) |
|---|---|---|
| 1 | 1 | 2.8 V |
| 1 | 0 | 2.7 V |
| 0 | 1 | 2.6 V |
| 0 | 0 | 2.5 V |

As seen in TABLE 1, the output voltage Vout increases by 0.1V when receiving logic signals. The output voltage Vout may be varied depending on values of the first resistor R4, the second resistor R5, the third resistor R6, and the fourth resistor R7.

Figure 2:
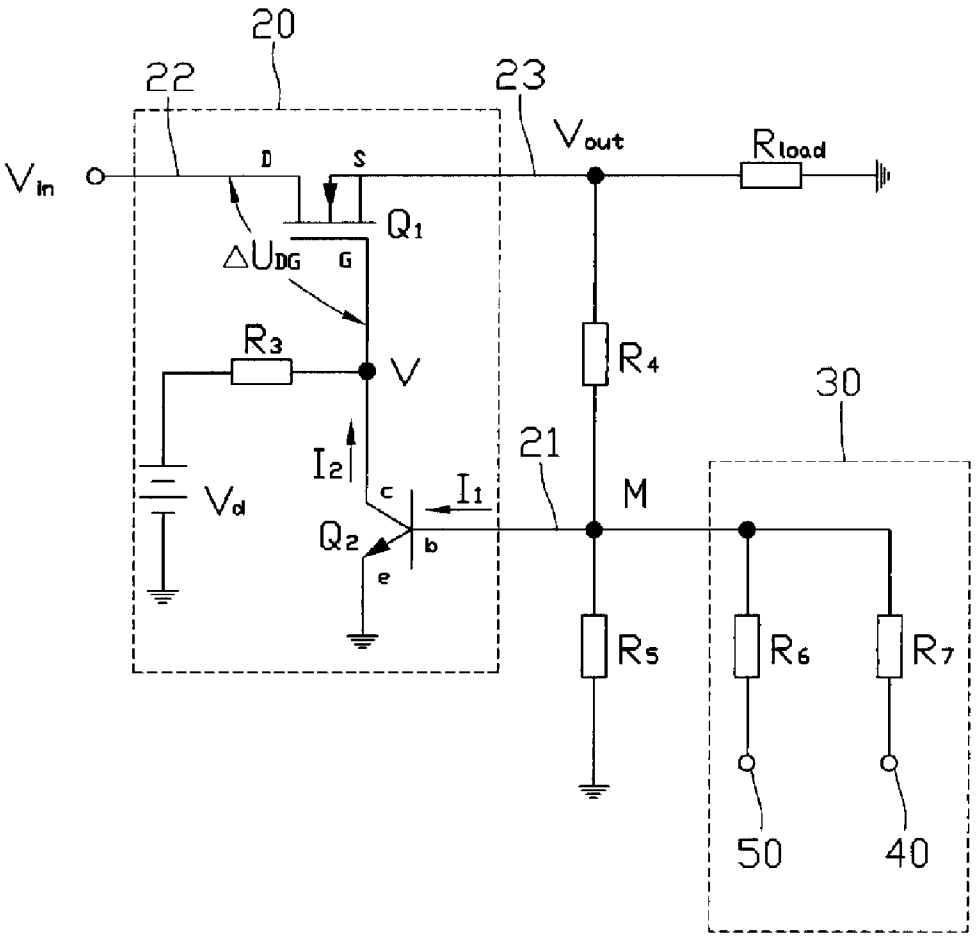
FIG. 2 is a circuit diagram of a linear voltage regulator which provides a selectable output voltage in accordance with a second embodiment of the present invention.
Figure 3:
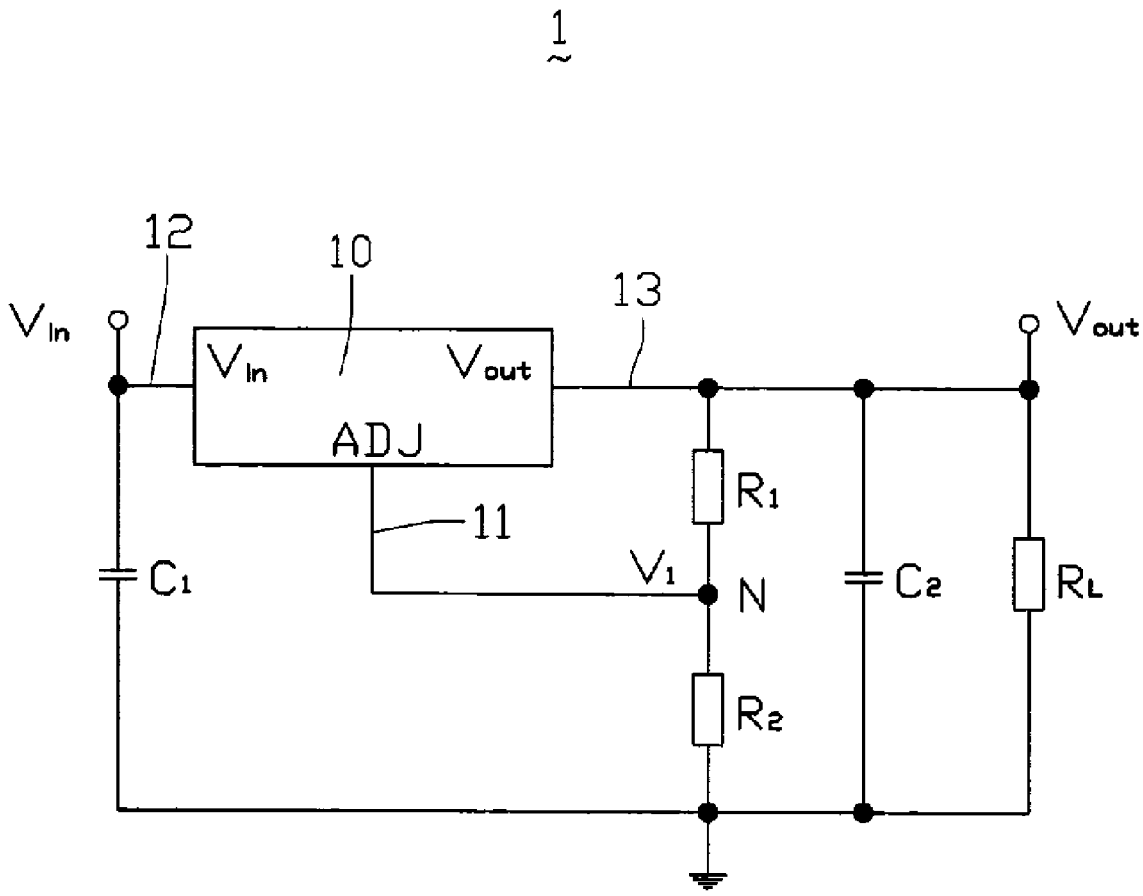
FIG. 3 (RELATED ART)
FIG. 3 is a circuit diagram of a typical linear voltage regulator.

FIG. 2 shows a linear voltage regulator with selectable output voltage in accordance with a second embodiment of the present invention. The second embodiment is advantageous in that it does not include the first switch Q3, and the second switch Q4, and the other terminals of the third resistor R6 and the fourth resistor R7 direct act as controlling signal input ends 50 and 40 for receiving logic signals from the controlling chip to control the third resistor R6 and the fourth resistor R7 connected to ground for participating in the output voltage Vout sampling.

When the controlling signal input ends 50 and 40 receive the logic signals "11", "10", "01" and "00", the output voltage Vout can be expressed as.

$$Vout = Vref * \left(1 + \frac{R4}{R5}\right)$$

$$Vout = Vref * \left(1 + \frac{R4}{\frac{R5 * R7}{R5 + R7}}\right)$$

$$Vout = Vref * \left(1 + \frac{R4}{\frac{R5 * R6}{R5 + R6}}\right)$$

$$Vout = Vref * \left(1 + \frac{R4}{\frac{\frac{R5 * R6}{R5 + R6} * R7}{\frac{R5 * R6}{R5 + R6} + R7}}\right)$$

In the second embodiment, when the input voltage Vin is 3.3V, the driving voltage Vd is 12V, then a relationship of the controlling signal input ends 50 and 40 receiving the logic signals and the output voltage Vout is shown as follows:

TABLE 2

Relationship between Logic Signals and Output Voltage

| Controlling Signal Input End 50 | Controlling Signal Input End 40 | Output voltage Vout (V) |
|---|---|---|
| 1 | 1 | 2.5 V |
| 1 | 0 | 2.6 V |
| 0 | 1 | 2.7 V |
| 0 | 0 | 2.8 V |

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A linear voltage regulator with a selectable output voltage comprising:

a regulating means comprising an input pole for receiving an input voltage, an output pole for providing an output voltage to a load, and a controlling pole for receiving a driving voltage;

a transistor comprising a base, an emitter being grounded, and a collector being connected to the controlling pole;

a first resistor and a second resistor directly connected between the output pole of the regulating means and ground for receiving the output voltage; and a voltage sampling control circuit electrically connected to a node between the first resistor and the second resistor comprising a third resistor and a fourth resistor, a common terminal of the third resistor and the fourth resistor being connected to the node between the first resistor and the second resistor, the other terminals of the third resistor and the fourth resistor acting as controlling signal input ends for receiving logic signals from a controlling chip, the voltage sampling control circuit generating a reference current to the base of the transistor to provide a selectable output voltage.

2. The linear voltage regulator as claimed in claim 1, wherein the voltage sampling control circuit further comprises a first switch and a second switch being connected between the other terminals of the third resistor and the fourth resistor of the voltage sampling control circuit and the controlling signal input ends, first terminals of the first switch and the second switch are respectively connected to the other terminals of the third resistor and the fourth resistor, second terminals of the first switch and the second switch are respectively connected to ground, third terminals of the first switch and the second switch act as the controlling signal input ends for receiving the logic signals to control the third resistor and the fourth resistor connected to ground for participating in the output voltage sampling.

3. The linear voltage regulator as claimed in claim 2, wherein the first switch and the second switch are p-channel metal-oxide semiconductor field effect transistors (MOSFETs), and the first terminals of the first switch and the second switch are drains, the second terminals of the first switch and the second switch are sources, and the third terminals of the first switch and the second switch are gates.

4. The linear voltage regulator as claimed in claim 1, wherein the transitor is a bipolar transistor.

5. The linear voltage regulator as claimed in claim 1, wherein the regulating means comprises a n-channel metal-oxide-semiconductor field-effect transistor (MOSFET), the controlling pole is a gate of the regulating means, the input pole is a drain of the regulating means, and the output pole is a source of the regulating means.

6. A linear voltage regulator with a selectable output voltage comprising:

a regulating means comprising a controlling pole, an input pole and an output pole, the controlling pole receiving a driving voltage, the input pole receiving an input voltage, the output pole providing an output voltage;

a transistor including a base receiving a reference current, an emitter being grounded, and a collector being connected to the controlling pole;

a voltage divider receiving the output voltage and providing the reference current to the base; and a voltage sampling control circuit for receiving the output voltage comprising:

two resistors, a common terminal of the resistors being connected to the voltage divider; the other terminals of the resistors acting as controlling signal input ends for receiving logic signals from a controlling chip to control the resistors to be connected to ground.

7. The linear voltage regulator as claimed in claim 6, wherein the voltage sampling control circuit further comprising a first switch and a second switch being connected between the other terminals of the resistors of the voltage sampling control circuit and the controlling signal input ends, first terminals of the first switch and the second switch are respectively connected to the other terminals of the third resistor and the fourth resistor, second terminals of the first switch and the second switch are respectively connected to ground, third terminals of the first switch and the second switch act as the controlling signal input ends for receiving the logic signals to control the third resistor and the fourth resistor connected to ground for participating in the output voltage sampling.

8. The linear voltage regulator as claimed in claim 7, wherein the first switch and the second switch are p-channel metal-oxide semiconductor field effect transistors (MOSFETs), and the first terminals of the first switch and the second switch are drains, the second terminals of the first switch and the second switch are sources, and the third terminals of the first switch and the second switch are gates.

9. The linear voltage regulator as claimed in claim 6, wherein the voltage divider comprises two resistors connected in series between the output pole and ground, and a node between the resistors of the voltage divider provides the reference current to the base.

10. The linear voltage regulator as claimed in claim 6, wherein the linear voltage regulator generates an orderly range of output voltages with equal differences between each output voltage through receiving the logic signals.

11. The linear voltage regulator as claimed in claim 6, wherein the regulating means comprises a n-channel metal-oxide-semiconductor field-effect transistor (MOSFET), the controlling pole is a gate of the regulating means, the input pole is a drain of the regulating means, and the output pole is a source of the regulating means.

12. A linear voltage regulator comprising:

a regulating circuit comprising an input terminal to accept an input voltage from an power source, an output terminal to transmit a regulated output voltage out of said regulating circuit, and an adjusting terminal extending out of said regulating circuit to accept controllable reference currents for adjustment of said regulating circuit;

a voltage divider electrically connectable between said output terminal and said adjusting terminal of said regulating circuit so as to accept said output voltage from said output terminal and provide said controllable currents to said adjusting terminal, said voltage divider comprising a first resistor electrically connectable between said output terminal and said adjusting terminal of said regulating circuit, and a second resistor comprising an end directly electrically connectable to said adjusting terminal of said regulating circuit and another end directly electrically connectable to ground; and a voltage sampling control circuit comprising at least one resistor electrically connectable to said adjusting terminal of said regulating circuit in a parallel connective arrangement with said second resistor of said voltage divider, each of said at least one resistor of said voltage sampling control circuit adapted to be responsive to logic signals received by said voltage sampling control circuit so as to adjust said controllable currents together with said second resistor of said voltage divider when said controllable currents are provided to said adjusting terminal of said regulating circuit.

13. The linear voltage regulator as claimed in claim 12, wherein said voltage sampling control circuit comprises two resistors arranged in a parallel connective manner.

14. The linear voltage regulator as claimed in claim 12, wherein said regulating circuit comprises a regulating means and a transistor, said regulating means comprises a controlling pole, an input pole serving as said input terminal of said regulating circuit, and an output pole serving as said output terminal of said regulating circuit, a base of said transistor serves as said adjusting terminal of said regulating circuit, an emitter of said transistor is directly grounded, a collector of said transistor is directly connectable to said controlling pole of said regulating means.

* * * * *